US005652998A

United States Patent [19]

McKenzie

[11] Patent Number: 5,652,998

[45] Date of Patent: Aug. 5, 1997

[54] CHILD SAFETY DOOR STOP MECHANISM

[76] Inventor: James M. McKenzie, 3613 W. River Ridge Ct., Mequon, Wis. 53092

[21] Appl. No.: 545,425

[22] Filed: Oct. 19, 1995

[51] Int. Cl.[6] ..... E05F 5/04

[52] U.S. Cl. ..... 16/83

[58] Field of Search ..... 16/82, 83, DIG. 17; 292/DIG. 15, 34.12

[56] References Cited

U.S. PATENT DOCUMENTS

| | | | |
|---|---|---|---|
| D. 303,756 | 10/1989 | Meyers | D8/402 |
| 597,425 | 6/1898 | Mumford | 16/83 |
| 1,354,079 | 9/1920 | Tate et al. | 16/83 |
| 1,414,286 | 4/1922 | Keller | 16/86 A |
| 2,065,685 | 12/1936 | Gaisman . | |
| 2,867,858 | 1/1959 | Wiesner . | |
| 3,172,168 | 3/1965 | Suska . | |
| 4,770,450 | 9/1988 | Dacus | 292/258 |
| 4,831,668 | 5/1989 | Deininger | 16/319 |
| 4,982,474 | 1/1991 | Kjellstrom | 16/82 |
| 5,123,685 | 6/1992 | Donovan | 29/262 |
| 5,369,840 | 12/1994 | Salvador et al. | 16/82 |

FOREIGN PATENT DOCUMENTS

| | | | |
|---|---|---|---|
| 249705 | 7/1912 | Germany | 16/83 |
| WO9105127 | 4/1991 | WIPO | 16/82 |

*Primary Examiner*—Chuck Y. Mah

[57] ABSTRACT

The present invention relates to a door stop mechanism to be used as a child safety device. The door stop mechanism of the invention is for a door with a rotating door opening mechanism and a door jamb. The invention includes a blocking element, a flexible positioning member and an attachment hook member integrally joined to form a single molded structure. The door stop mechanism of the invention is attached to the rotating shaft of a door opening mechanism, such that the door stop mechanism will rotate in direct relation to the rotation of the door opening mechanism. In its closed position, the door stop mechanism rests across the edge of the door to prevent the door from completely closing. To close the door, the door opening mechanism must be rotated and held in this rotated position while closing the door. When the door opening mechanism is rotated, the blocking element of the present invention is moved away from the door edge which allows the door to be closed. Since the door opening mechanism must be held in a rotated position, the door stop mechanism of the invention prevents the door from being unintentionally shut by a small child, or other person.

8 Claims, 2 Drawing Sheets

16
29
26
28
27
10
14
25
24
12
18
22
20
32
34
30

48
36
42
38
46
44
24
14
18
22
12

16

42
30
36
40

48
44
12
5
49
5
53
50
51

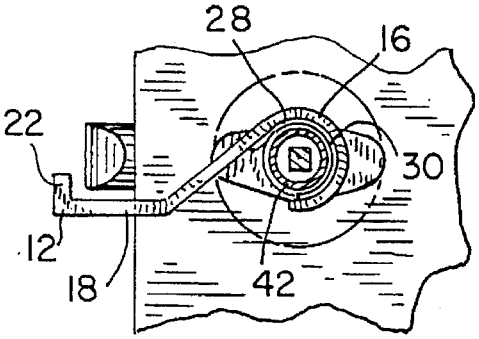
FIG. 5
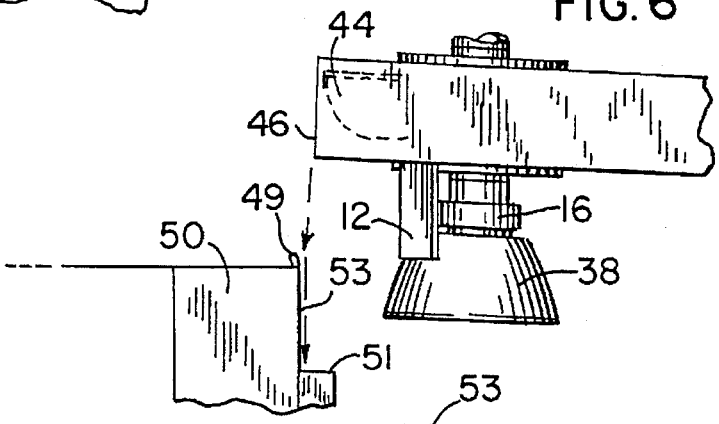
FIG. 6
FIG. 7
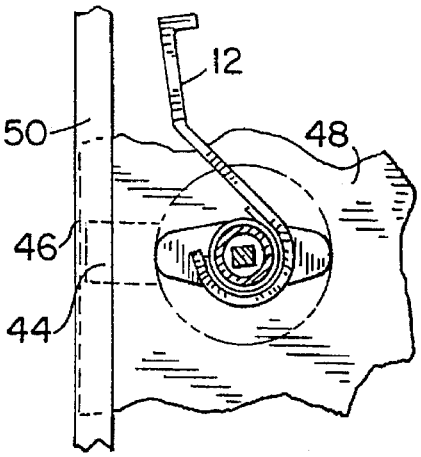
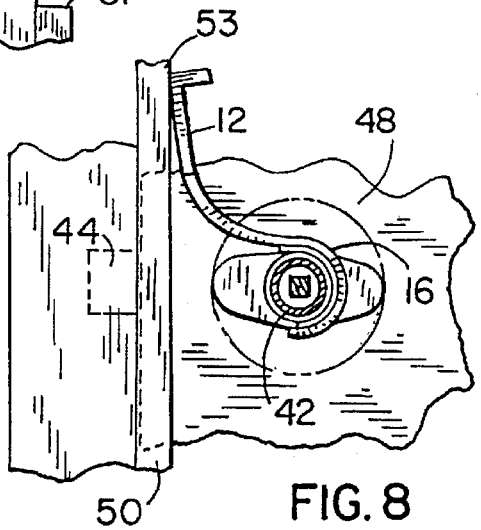
FIG. 8
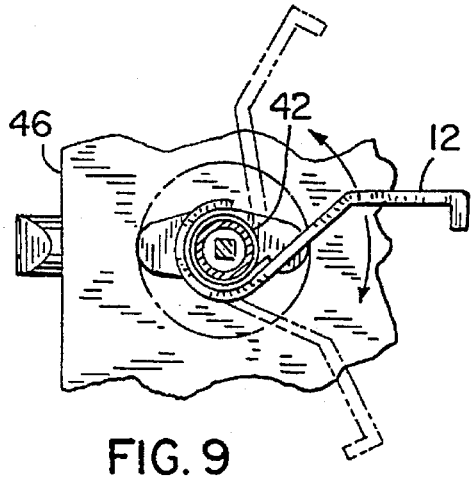
FIG. 9
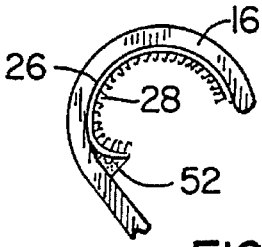
FIG. 10

CHILD SAFETY DOOR STOP MECHANISM

BACKGROUND OF THE DISCLOSURE

The present invention relates to a door stop which is particularly useful as a child safety device.

Each year a large number of people, particularly children, are injured when their hands or fingers are crushed by a closing door. Children are extremely susceptible to injuries of this nature because of their inquisitive nature and diminutive size and strength combine to create many potentially dangerous situations. While many accidents occur which only cause relatively minor pain and bruises, other injuries involving relatively heavy doors can cause broken bones or even permanent disfigurement of the child.

Many items have been developed to prevent doors from either opening or closing. The typical door stop usually includes a weighted item which is placed on the floor near the door to keep the door in either an open or closed position. These devices, however, can easily be moved by the child and therefore are not very reliable or safe. An improved door stop which is easy to use would be a welcome addition in the field of child safety devices.

SUMMARY OF THE INVENTION

In accordance with the present invention, a door stop for a door with a rotatable door opening mechanism and a door jamb is provided.

The door stop of the present invention utilizes a blocking element which is capable of withstanding the closing force asserted on an object positioned between the closing door and the door jamb. The blocking element is constructed of a material rigid enough to maintain its shape upon impact, yet flexible enough to prevent damage to the door upon closing. The blocking element of the invention is constructed of a width such that when it is placed between the door and the door jamb, the gap between the door and the door jamb is wider than the width of a human finger or hand.

The blocking element of the invention is connected at one end to a flexible positioning member, which is, in turn, connected to an attachment hook. The blocking element, the flexible positioning member, and the attachment hook are molded together in such a manner as to create a single structure.

The attachment hook of the invention is placed around the rotating shaft section of the door opening mechanism, such as a door knob or handle, and is held in fixed relation to this rotating section by a securing means, such as mating strips of a hook and pile fastener. By securing the attachment hook of the invention to the rotating shaft of the door opening mechanism, the blocking element of the invention will move in a direct relation to the rotation of the door opening mechanism. When the door is open and the door opening mechanism is rotated to its open position, the blocking element of the invention will be located in a substantially vertical position away from the edge of the door and the door jamb. When the door is open and the door opening mechanism is in its closed position, the blocking element of the invention is located in a substantially horizontal plane. While in the substantially horizontal plane, the blocking element extends past the edge of the door and will contact the door jamb to prevent the door from completely shutting. Since the blocking element will be located between the edge of the door and the door jamb, it will prevent the door from crushing or contacting an object located between the edge of the door and the jamb, such as the hand or finger of a small child.

To close the door completely, the rotating door mechanism must be held in its open position, at which time the blocking element of the invention is located in a vertical position. With the door opening mechanism held in an open position, the door can be closed since the blocking element is located away from the edge of the door. Once the door is closed, the door opening mechanism can be released to allow the door opening mechanism to return to its resting position and allows the door bolt to extend into the door jamb. As the door opening mechanism returns to its resting, closed position, the blocking element of the invention also attempts to return to its horizontal blocking position. The inside surface of the door jamb, however, prevents the blocking element from returning to a horizontal position. At this time, the flexible positioning member bends to allow the blocking element to remain in a somewhat vertical position while the fixed attachment hook returns with the rotating shaft to its closed position. Therefore, to completely close the door, a person must hold the door opening mechanism in an open position while closing the door at the same time. This prevents small children from closing the door, since they are often unable to hold the door opening mechanism in an open position while at the same time closing the door.

The blocking element of the present invention is constructed of a material which is flexible enough to prevent damage to the door and door jamb, while being rigid enough to maintain its shape upon closing of the door. To provide further strength to the blocking element, the blocking element contains an expanded end region to increase the amount of force the blocking element can withstand.

The door stop of the present invention can also be removed and stored in a convenient position. When the door stop of the present invention is no longer needed, such as when children are no longer present, the door stop can be detached from the door opening mechanism and repositioned such that the door stop will no longer be in a position to prevent the closing of the door.

DESCRIPTION OF THE DRAWINGS

FIG. 5 is a frontal view, partially in section, of the door stop and showing the attachment to the rotating shaft of a door opening mechanism;

FIG. 6 is a top plan view of the door stop in its open position;

FIG. 7 is a frontal view, partially in section, showing the door stop mechanism in its open position;

FIG. 8 is a frontal view, partially in section, showing a door stop with the door completely closed;

FIG. 9 is a frontal view, partially in section, showing of an alternative attachment of the door stop when not in use; and FIG. 10 is a side view of the attachment hook and securing means of the door stop mechanism.

DESCRIPTION OF THE ILLUSTRATED EMBODIMENT

Figure 1:
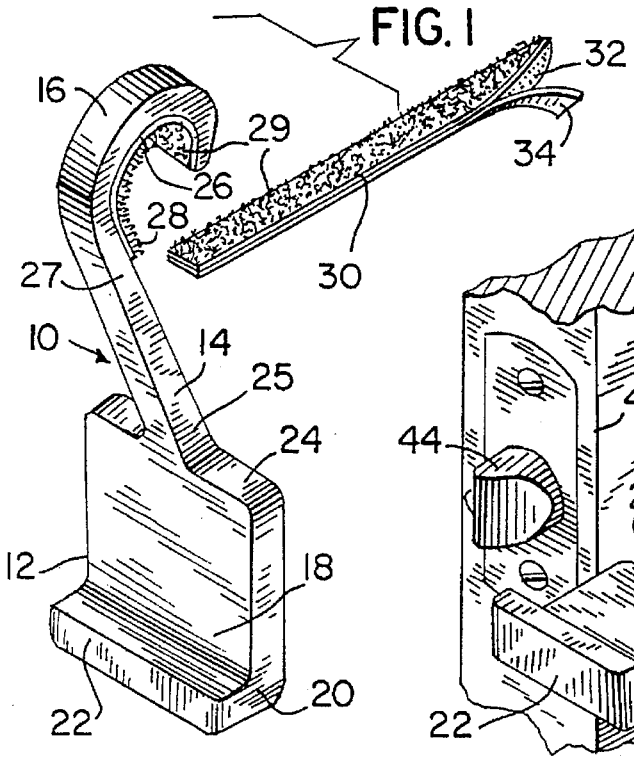
FIG. 1 is an isometric view of the door stop of the present invention and the related securing means.

Referring to the drawings, and in particular FIG. 1, the door stop of the invention is generally indicated by reference numeral 10. The invention is comprised of a blocking element 12 joined at one end to a flexible positioning member 14, which in turn is connected to an attachment hook 16. As can be seen in FIG. 1, the blocking element 12, the positioning member 14, and the attachment hook 16 are molded together to form a single unitary structure in the preferred embodiment.

The blocking element 12 includes a strike plate 18 and an expanded strengthening section 20 having a reinforcement lip 22 projecting therefrom. Reinforcement lip 22 is useful in preventing the strike plate 18 from buckling when the invention is used as hereinafter described. The reinforcement lip 22 and strike plate 18 form a generally L-shaped structure when viewed from the side, as shown in FIG. 5. The attachment end 24 of the strike plate 18 is located directly opposite of the reinforcement lip 22 and is connected to the first end 25 of flexible positioning member 14. In the preferred embodiment of the invention, blocking element 12 is constructed of a urethane material.

A strike plate 18 of a greater thickness than shown in the Figures may be used, such that if the strike plate 18 were inadvertently turned sideways before the door was closed, the added thickness of the strike plate 18 would still prevent the fingers of small children from being slammed between the door and the door jamb.

Figure 3:
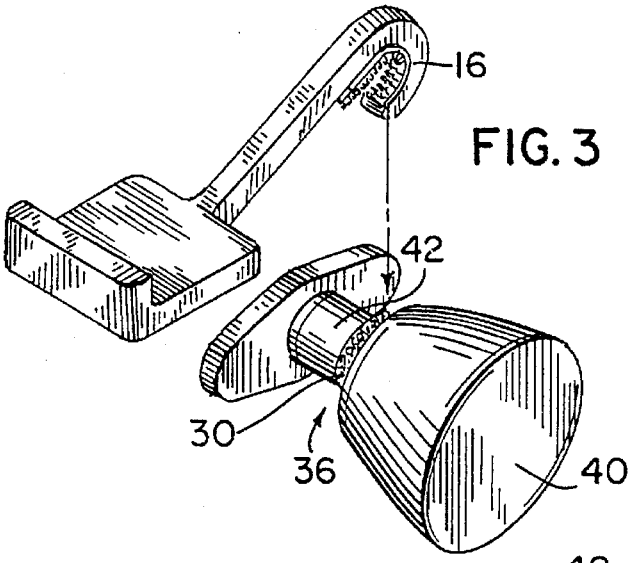
FIG. 3 is an exploded top right isometric view of the door stop of the present invention showing the installation on a door opening mechanism.

As can best be seen in FIG. 3, the flexible positioning member 14 is connected to the blocking section 12 in an angular orientation relative to the horizontal plane of the blocking element 12. The flexible positioning member 14 extends laterally from the blocking element 12 and terminates at its second end 27 with the attachment hook 16.

The attachment hook 16 is a curved semi-circular extension of the flexible positioning member 14. Contained on the interior semi-circular surface 26 of the attachment hook 16 is a securing means 29, such as a hook and pile connector, an adhesive surface member, or the like. In the preferred embodiment of the invention, the securing means 29 contained on the inner surface 26 of the attachment hook is the hook portion 28 of a Velcro® fastener. The mating pile portion 30 of a Velcro® fastener is shown in FIG. 1 in its unattached state. As can be seen in FIG. 1, the pile portion 30 contains an adhesive surface 32 which can be exposed by pealing away backing 34 prior to attachment, as will be discussed hereinafter.

Figure 2:
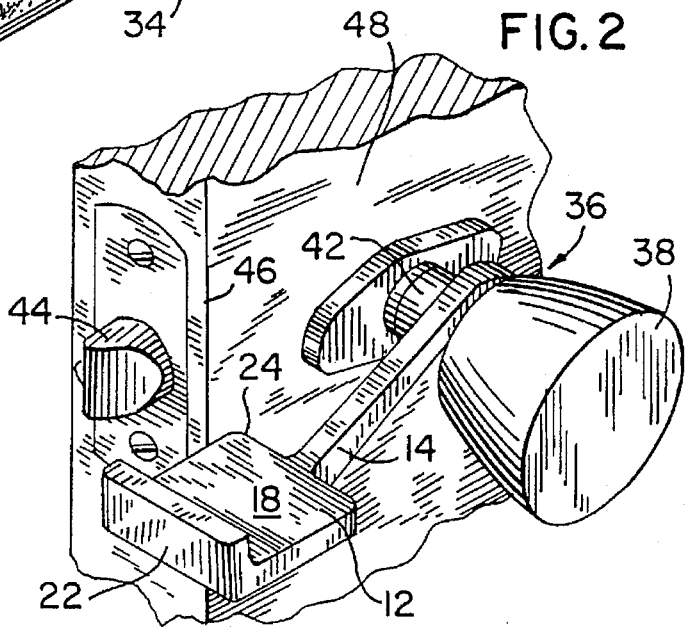
FIG. 2 is a top right isometric view of the door stop of the present invention as installed on a door having a door opening mechanism.

Referring now to FIG. 2, the door stop 10 of the present invention is shown in its operating position. The door stop 10 is connected to a rotatable door opening mechanism generally designated 36. The rotatable door opening mechanism 36 can take one of several forms, such as a door handle, or as shown in the preferred embodiment, a common household door knob 38. The door knob 38 is mechanically connected to a rotating shaft 42. When the door knob 38 is turned by the user, the rotating shaft 42 moves in direct relation to the rotation of the door knob 38. This rotation causes the bolt 44 of the door 48 to move from its closed position, wherein the bolt 44 is fully extended, as shown in FIG. 2, to an open position wherein the bolt 44 is completely withdrawn into the door 48.

As can best be seen in FIG. 3, one portion of the hook and pile securing means 29 is attached to the rotating shaft 42 of the door opening mechanism 36. In the preferred embodiment, the pile portion 30 is attached to the rotating shaft 42. With half of the securing means 29 securely in place on the shaft 42, the attachment hook 16 containing the mating hook portion 28 is placed around the rotating shaft 42 of the door knob 38, as the phantom line in FIG. 3 indicates. The attachment hook 16 extends to cover a substantial portion of the rotating shaft 42 to securely hold the door stop 10 in place. While the attachment hook 16 shown in the Figures covers slightly over half of the rotating shaft 42, it is contemplated that the attachment hook 16 could be lengthened or widened to contact a greater surface area of the rotating shaft 42.

As can be seen in FIG. 2, when the door 48 is open, the positioning member 14 is of an adequate length to position the blocking element 12 such that the edge surface 46 of door 48 contacts the blocking section 12 at a point on the strike plate 18 between the attachment end 24 and the reinforcement lip 22.

With the door initially open and the door stop 10 connected to the rotatable door opening mechanism 36, as shown in FIG. 2, the blocking element 12 is in a substantially horizontal position to be interjected between the door edge 46 and the door jamb 50 to prevent the door 48 from completely closing. In the preferred embodiment of the invention, the blocking element 12 is made of a molded urethane material or any suitable material such that blocking element 12 is rigid enough to withstand the closing force of the door, while still flexible enough to prevent damage to the door edge 46 and door jamb 50 upon contact. The door opening mechanism 36 is shown in FIGS. 2–5 in its resting position with door 48 open and with no rotational forces being applied to the door knob 38. In this position, the door 48, without the door stop 10 in place, can be closed by pulling the door 48 toward door jamb 50, at which time the door plate 49 of the door jamb 50 forces the bolt 44 into the interior of the door 48 until the door 48 is completely closed and resting against ledge 51. With the door in its closed position, bolt 44 returns to its extended position and holds the door closed. The operation of a door opening mechanism 36 and bolt 44 in this manner is well known in the prior art.

As shown in FIG. 5, the attachment hook 16 is attached in an orientation such that blocking element 12 lies in a substantially horizontal plane when the door 48 is open and the door opening mechanism 36 is in its resting position. FIG. 5 also illustrates the fixed connection between the hook and pile portions 28,30 of securing means 29 and the rotating shaft 42 of the door knob 38.

With the door stop 10 in place, the blocking element 12 prevents the door 48 from accidentally closing and, therefore, prevents objects, such as human fingers or hands, from being slammed between the edge of the door 48 and the door jamb 50. Closing the door 48 from an open position with the door stop 10 attached to the rotating shaft 42 of the door knob 38 is done as follows. The door knob 38 is rotated in a clockwise direction until the blocking element 12 is in a substantially vertical plane and the bolt 44 is in its retracted position, as shown in FIG. 6. Since the attachment hook 16 is in fixed contact with the rotatable shaft 42, the clockwise rotation of the door knob 38 causes the attachment hook 16 and, therefore, the blocking element 12 to rotate in direct correspondence thereto. Rotating the door knob 38 causes bolt 44 to move into the interior of the door 48. This clockwise rotation of the door knob 38 is the identical function which must be performed to open the door 48 from a closed position.

To close the door 48, the door knob 38 must be held in its rotated position shown in FIG. 6 until the door 48 is completely closed, as shown in FIG. 7. As can be seen in FIG. 7, the blocking element 12 is located in a substantially vertical position away from both the door edge 46 and the door jamb 50. With the door knob 38 of the door opening mechanism 36 held in its open position, the door edge 46 contacts door ledge 51 and the door 48 is in a completely closed position. Once the door 48 is in this closed position, the door knob 38 can be released and allowed to return to its normal position with no force being applied to it.

Referring to FIG. 8, when the door is closed and the door knob 38 released, the rotating shaft 42 and door knob 38 of the door opening mechanism 36 return to their resting position. Since the attachment hook 16 is in fixed contact with the rotating shaft 42, releasing the door knob 38 results in the blocking element 12 attempting to move from a substantially vertical position to a substantially horizontal position. Because the door 48 is in a closed position and in contact with door ledge 51, the interior surface 53 of door jamb 50 prevents the blocking element 12 from returning to a horizontal position. The flexible positioning member 14 allows the attachment hook 16 to completely rotate while flexing to accommodate the limited movement of blocking element 12. In this closed position, the bolt 44 holds the door 48 shut and prevents it from opening until a rotation force is again placed on the door knob 38.

Figure 4:
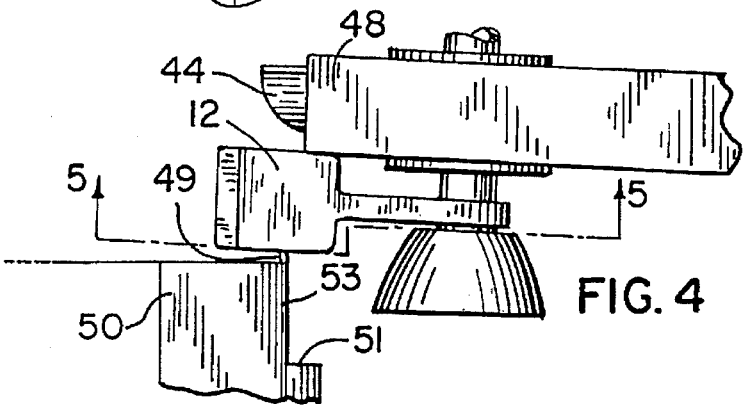
FIG. 4 is a top plan view showing the door stop of the invention interjected between the door and a door jamb.

If a rotational force is placed on the door knob 38, the door stop mechanism 10 and the bolt 44 assume the position shown in FIG. 7, which allows the door 48 to be opened. Once the door 48 is in an open position, the rotational force is removed from door knob 38 and the door stop 10 again assumes the position shown in FIG. 2, where the blocking element 12 is in a horizontal position located across the door edge 46 to prevent the door from accidentally closing, as shown in FIG. 4.

During normal operation without the doorstop 10 in place, the door 48 can be pulled shut without any rotational force applied to door knob 38. With the door stop 10 in place and the door 48 open, if no force is applied to the door knob 38, the blocking element 12 remains in a substantially horizontal position to prevent the door 48 from closing. Therefore, the door stop 10 of the invention prevents a child, who is usually neither tall enough nor strong enough to apply the rotational force needed, from closing the door. Since the door 48 will not be able to completely close, the door stop 10 will prevent many injuries to small children's hands and fingers.

FIG. 9 illustrates a second method of connecting the door stop 10 for use in storing the door stop 10 when children are not present. In this connection, the blocking element 12 is located in a direction directly opposite the door edge 46 when the door opening mechanism 36 is in its resting position. When the door knob 38 is rotated to open the door 48, the blocking element 12 moves from the position shown to one of the two secondary positions shown by the phantom lines in FIG. 9. By attaching the door stop 10 in such a manner, the door stop 10 can be left attached to the rotating shaft 42 while not effecting the operation of the door 48. This allows the door stop 10 to be stored in a position where it can be easily and quickly found when children are present and the added safety of the door stop 10 is needed.

FIG. 10 shows the Velcro® securing means 29 of the preferred embodiment of the invention. In the preferred embodiment, the hook portion 28 is attached to the interior semi-circular surface 26 of the attachment hook 16 by the means of an adhesive surface 52 on the back of the hook portion 28. In the preferred embodiment of the invention, the hook portion 28 of the securing means 29 is attached to the attachment hook 16 and the pile portion 30 of the securing means 29 is attached to the rotating shaft 42. Since the portion of the securing means 29 connected to the rotating shaft 42 remains in place even if the door stop 10 is removed, the softer surface of the pile portion 30 is selected to be placed on the rotating shaft 42, since this portion will be less abrasive to children's skin.

In an alternative embodiment of the invention, not shown, the strike plate 18 of blocking element 12 can contain one or more removed portions of material, such as an aperture extending therethrough. An aperture through strike plate 18 would result in strike plate 18 having increased flexibility when contacted by door 48, so as to prevent chipping or damage to door edge 46 or door jamb 50 when the door stop 10 prevents closure of door 48.

Various alternatives and embodiments are contemplated as being within the scope of the following claims particularly pointing out and distinctly claiming the subject matter regarded as the invention.

I claim:

1. A door stop for a door pivotally mounted to a door jamb, the door moveable between a first open position and a second closed position with a door opening mechanism rotatable between a first and a second position, comprising:

a blocking element having a first and a second end, said blocking element including an elongated strike plate member and an expanded second end;

a flexible positioning member having a first and a second end, said first end connected to said first end of said blocking element; and an attachment hook joined to the second end of said positioning member; and a detachable securing means adapted to be positioned between the attachment hook and the door opening mechanism to provide fixed contact between the attachment hook and the rotatable door opening mechanism such that said attachment hook and said blocking element rotate in direct relation to the rotation of the door opening mechanism.

2. The door stop as set forth in claim 1, wherein when the door is in the first open position, said attachment hook and said blocking element are rotatable between a first position wherein said blocking element is located in a substantially horizontal position to be interjected between the door and the door jamb to prevent closing of the door and a second position wherein said blocking element is located in a substantially vertical position away from the door jamb to permit closing of the door.

3. The door stop of claim 1, wherein said blocking element is constructed of a material flexible enough to prevent damage to the door and door jamb upon impact therewith.

4. The door stop of claim 1, wherein said blocking element is constructed of a material rigid enough to prevent deformation of said blocking element upon impact with the door and door jamb.

5. The door stop of claim 1, wherein said blocking element, said positioning element and said attachment hook are integrally molded together.

6. The door stop as set forth in claim 1, wherein said blocking element has a generally L-shaped profile.

7. The door stop as set forth in claim 1, wherein said securing means is a fastening material having a hook portion and a pile portion.

8. The door stop as set forth in claim 7, wherein the hook portion of said fastening material is mounted on said attachment hook and the pile portion of said fastening material is mounted on the rotatable door opening mechanism.

* * * * *